US005909764A

United States Patent [19]

Sartschev et al.

[11] Patent Number: 5,909,764

[45] **Date of Patent: *Jun. 8, 1999**

[54] VERTICAL CASTER AND ASSOCIATED METHOD

[75] Inventors: Adam J. Sartschev, Allison Park; Joshua C. Liu, Murrysville, both of Pa.

[73] Assignee: Aluminum Company of America, Pittsburgh, Pa.

[ * ] Notice: This patent is subject to a terminal disclaimer.

[21] Appl. No.: 09/036,308

[22] Filed: Mar. 6, 1998

Related U.S. Application Data

[63] Continuation-in-part of application No. 08/310,142, Sep. 20, 1994, Pat. No. 5,725,046.

[51] Int. Cl.[6] ..... B22D 11/06

[52] U.S. Cl. ..... 164/481; 164/431; 164/443; 164/485

[58] Field of Search ..... 164/481, 485, 164/431, 430, 432, 443

[56] References Cited

U.S. PATENT DOCUMENTS

| | | | |
|---|---|---|---|
| 4,061,178 | 12/1977 | Sivilotti et al. | 164/481 |
| 4,759,400 | 7/1988 | Bessho et al. | 164/481 |
| 4,905,753 | 3/1990 | Shio et al. | 164/431 |
| 4,964,456 | 10/1990 | Lauener | 164/481 |
| 5,725,046 | 3/1998 | Sartschev et al. | 164/431 |

FOREIGN PATENT DOCUMENTS

| | | |
|---|---|---|
| 864035 | 6/1978 | Belgium . |

*Primary Examiner*—J. Reed Batten, Jr.

*Attorney, Agent, or Firm*—David W. Brownlee; Charles Q. Buckwalter

[57] ABSTRACT

The caster includes a pair of movable opposed belts, each of the belts having a casting surface and a pair of movable opposed dam blocks including a plurality of dam blocks having one end mounted to an orbiting support and a casting surface opposite the mounted end. The casting surfaces of the belts and the casting surfaces of the dam blocks define a casting zone for solidifying the molten metal into cast metallic product. The caster also includes cooling plates/bars for cooling the belts while the belts pass through the casting zone.

20 Claims, 6 Drawing Sheets

VERTICAL CASTER AND ASSOCIATED METHOD

CROSS REFERENCE TO RELATED APPLICATION

This application is a continuation-in-part of U.S. Ser. No. 08/310,142, filed Sep. 20, 1994 and now U.S. Pat. No. 5,725,046.

BACKGROUND OF THE INVENTION

This invention relates to a generally vertical caster which produces metallic cast products such as bar, strip or slab from molten metal. The invention also includes a method of producing metallic cast product from molten metal and an associated metallic cast product.

Continuous casting of metallic bar, strip and slab is a well known process. One example of such a process is casting aluminum bar using a wheel-type caster. The aluminum bar is used as a starting product for producing aluminum rod and aluminum wire. The advantage of a continuous casting process over the conventional process of producing aluminum rod and wire from extruded, large (fifteen inches in diameter) billets is that the continuous casting process collapses certain manufacturing process steps resulting in the elimination of certain equipment and work stations. This, in turn, significantly reduces capital, labor, maintenance and energy consumption.

The known wheel-type continuous bar caster involves providing a revolving wheel having a trapezoidal groove in which molten aluminum is cast. The groove is covered by a steel or copper belt as the wheel and the cast molten aluminum revolve. The groove and the belt form a mold for casting the aluminum bar. The molten aluminum solidifies in the groove and then exits the wheel of the caster. The solidification process is accomplished by introducing a coolant on the back side of the belt and on the sides of the mold. After solidification, the aluminum bar is introduced into a shape rolling mill where the bar is shaped into aluminum rod. The aluminum rod is then quenched, lubricated and wound onto a coil.

Well known methods and apparatus for continuous casting of metal stripbetween belts are disclosed in U.S. Pat. Nos. 4,061,178 and 4,964,456, among others.

As is well known to those skilled in the art, the quality of the continuously cast aluminum product mainly depends on the thermal conditions during the solidification process. The rate of heat extraction has to be controlled in order to resist (i) surface liquation; (ii) build-up of residual stresses during solidification which can cause side cracking and break-up during casting or subsequent processing; and (iii) centerline segregation of alloying elements. Although many process improvements have been made to the wheel-type caster, the above problems are present, especially in casting certain alloys, such as 2XXX, 5XXX, 6XXX and 7XXX aluminum alloys.

Surface liquations are caused by the formation of an air gap between the solidifying aluminum product and the mold which causes remelting of the shell surface of the cast product. This problem can be solved by maintaining contact between the mold and the solidifying aluminum throughout the length of the casting process. However, as the wheel-type caster has a rigid mold on three sides, it is difficult, if not impossible, to maintain mold/cast product contact throughout the solidification process. In addition, the mold and belt will distort unpredictably thus also making it difficult to maintain mold/cast product contact. Thus, there is a need for a bar casting process and apparatus that provides good mold/bar contact to resist surface liquation and to improve general surface quality of the cast product.

The partially solidified product bending in the round wheel mold causes side bar cracking and product break-up during casting and rolling. Different alloys exhibit different propensities for build-up of residual stresses. This problem is related to heat transfer rates over the length of the solidification zone and can be controlled by careful manipulation of coolant application at strategic locations in the casting process. This requires a casting process with flexibility to vary heat transfer rates over the solidification zone, so that different alloys can be successfully cast. Although improvements in manipulating the coolant application in the wheel-type caster have been made, there is still needed a casting process and apparatus that provides flexibility to vary heat transfer rates over the length of the solidification zone.

In addition, for longer freezing range alloys (i.e., 2XXX, 4XXX, 6XXX and 7XXX) there must be a very efficient coolant application apparatus in order to quickly extract heat from the solidified metal. The wheel-type caster does not provide the type of high cooling rates that are needed to efficiently solidify the cast product. The inefficient cooling causes centerline segregation of the alloying elements which is a universally undesirable result. Thus, there is still needed a caster having a cooling system which efficiently removes heat from the cast molten metal in order to form high quality cast aluminum product.

SUMMARY OF THE INVENTION

The caster of the invention has met the above mentioned needs as well as others. The generally vertical caster for casting molten metal into metallic product such as bar, strip and slab comprises a pair of movable opposed belts, each of the belts having a casting surface and a cooling surface opposite the casting surface and a pair of opposed side dams having casting surfaces which cooperate with the casting surfaces on the belts to define a casting zone for solidifying the molten metal into cast metallic product. The caster further comprises cooling means for cooling the belts while they pass through the casting zone.

A method of casting molten metal into cast metallic product is also provided. The method comprises providing a generally vertical caster as described above having a pair of movable belts, a pair of side dam means and cooling means for cooling the belts. The method further comprises solidifying the molten metal in a casting zone defined by the casting surfaces of the belts and the casting surfaces of the side dams to form the cast metallic product.

A cast metallic product made by the method of the invention is also provided.

BRIEF DESCRIPTION OF THE DRAWINGS

A full understanding of the invention can be gained from the following description of the preferred embodiment when read in conjunction with the accompanying drawings in which.

DETAILED DESCRIPTION

Figure 1:
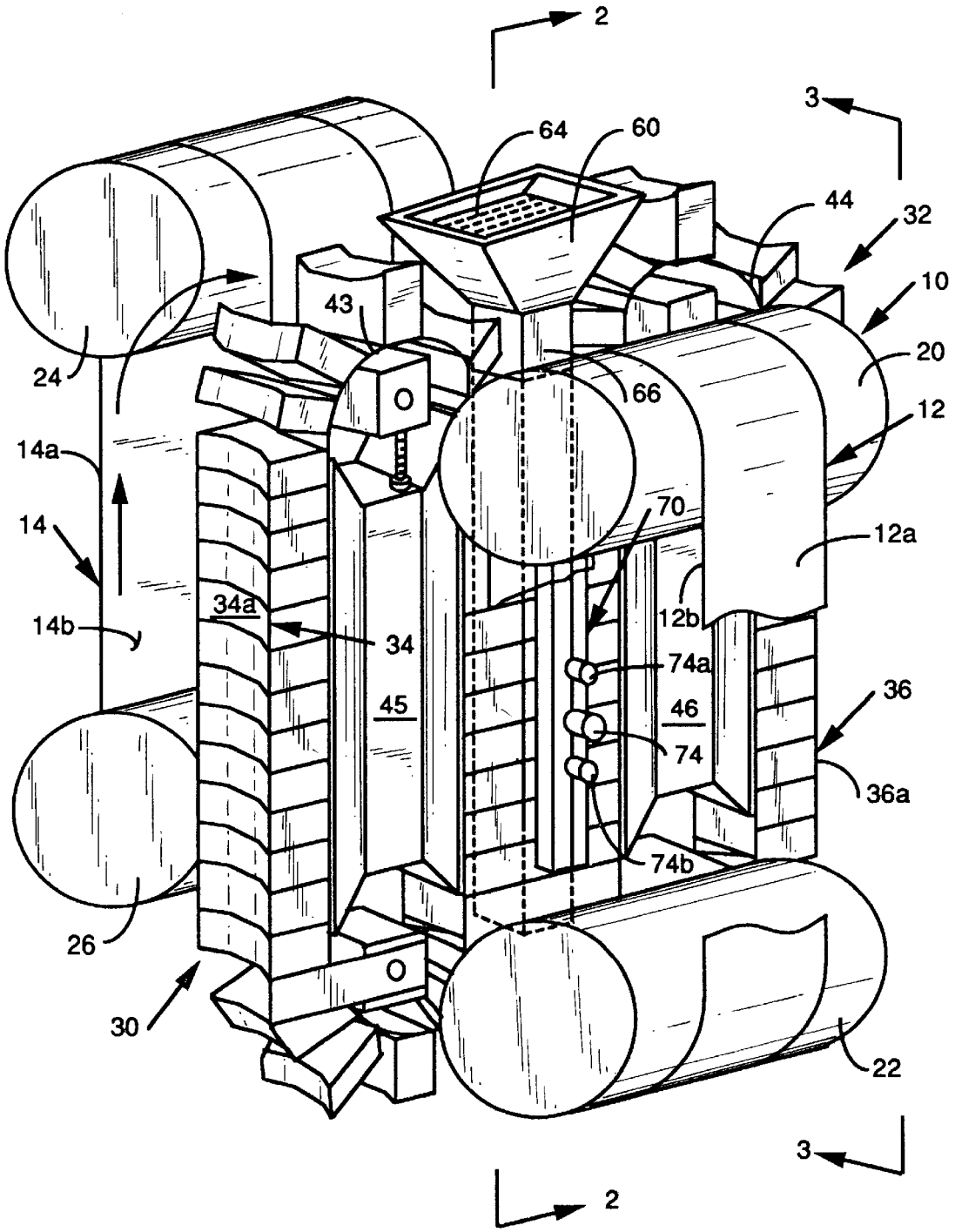
FIG. 1 is a perspective view of a generally vertical bar caster which embodies the invention.
Figure 2:
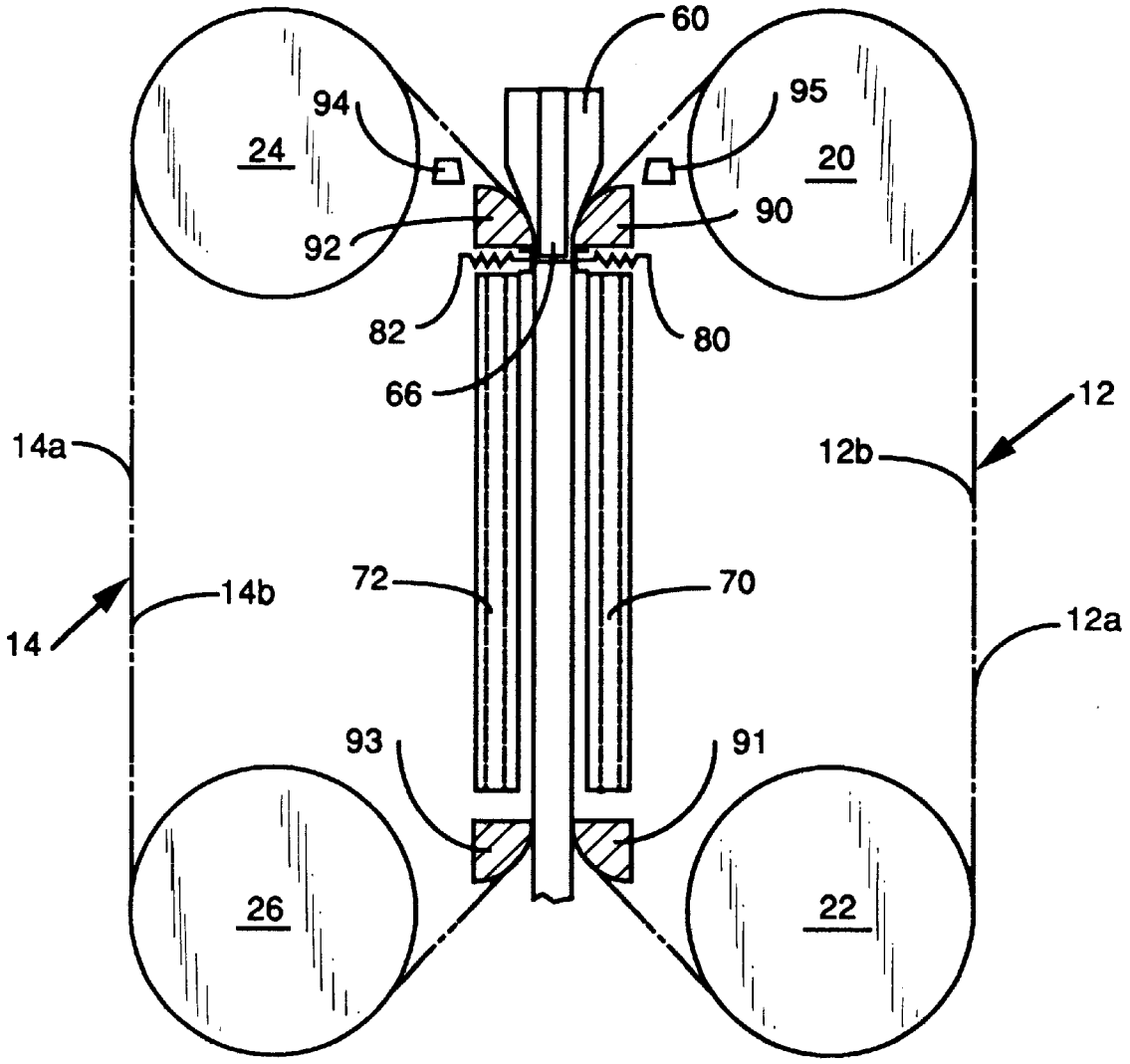
FIG. 2 is a view taken along line 2—2 of FIG. 1.
Figure 3:
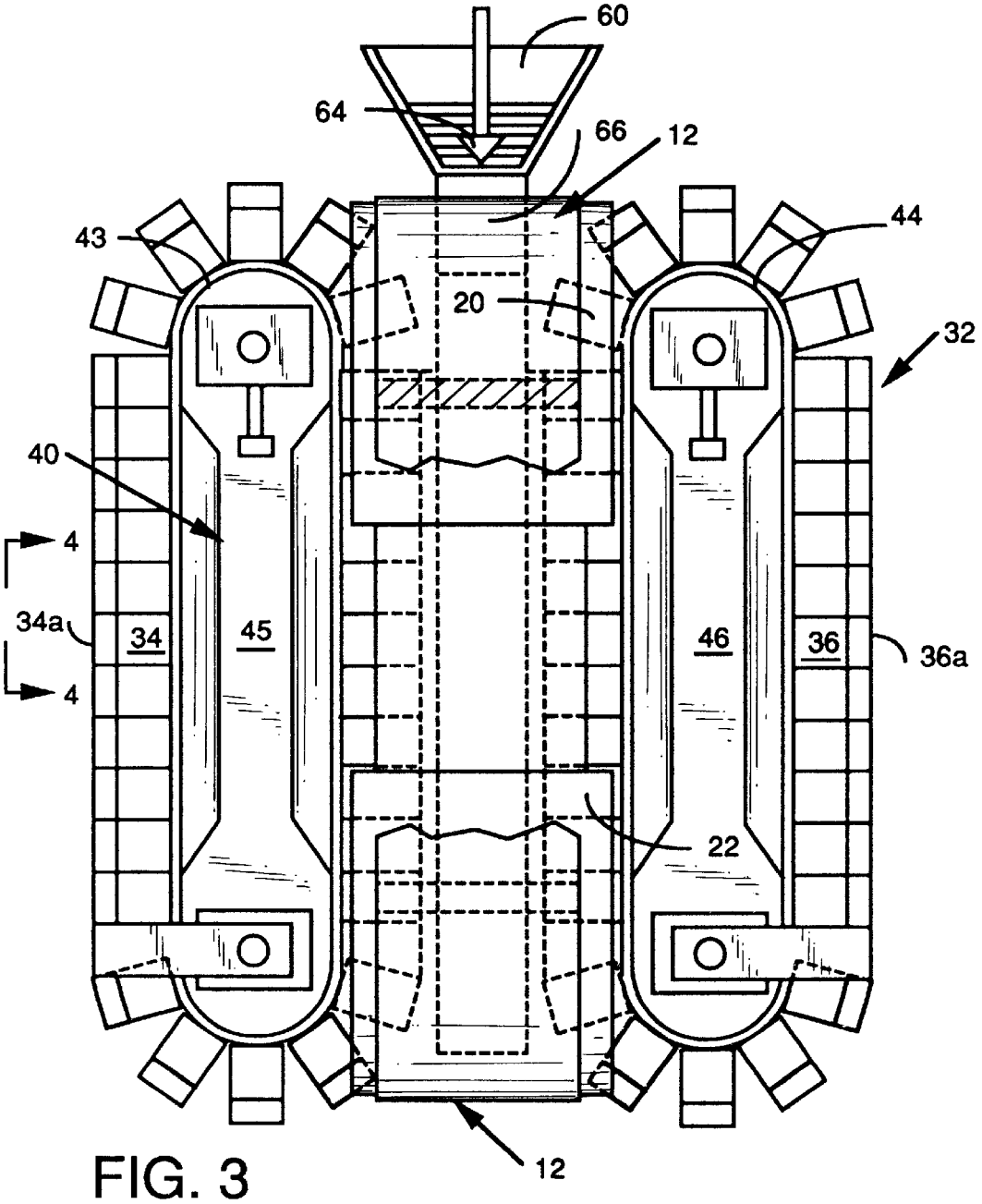
FIG. 3 is a view taken along line 3—3 of FIG. 1.

Referring now to FIGS. 1–3, an embodiment of a generally vertical bar caster 10 is shown. In general, the caster 10 consists of a pair of movable opposed belts 12 and 14 which are driven and supported by rolls 20, 22 and 24, 26 respectively. Alternative embodiments of the invention for casting other products, such as strip or slab products, have essentially the same configuration as shown in the figures, except for the dimensions of the casters. Casters for casting strip and slab products are wider than bar casters in order to cast metal strip or slab that is considerably wider than a typical bar product. For example, cast strip or slab may be as thin as 0.25 inch to 2.00 inches and up to 80 inches or more in width.

Referring again to FIGS. 1–3, it is preferred that rolls 20 and 24 are the idler rolls and rolls 22, 26 are the driver rolls, although it will be appreciated that, less preferably, this arrangement can be reversed, and rolls 22, 26 can be the driver rolls and rolls 20, 24 can be the idler rolls. The rolls are conventional in construction and are preferably from about twenty to fifty inches in diameter, depending on the belt thickness.

The rolls are mounted in a frame (not shown) and are adapted to move the belts at a rate of at least forty feet per minute. The belts 12 and 14 are preferably endless belts, although belts such as shown in U.S. Pat. No. 4,823,860, which is hereby expressly incorporated by reference herein, can be used. The belts 12 and 14 can be made of copper or steel and are approximately twelve to eighteen inches wide and about 0.010 to 0.050 inches thick. The belts 12 and 14 provide excellent heat transfer mediums for the cooling molten metal.

Belt 12 has a casting surface 12*a* and a cooling surface 12*b* and belt 14 has a casting surface 14*a* and a cooling surface 14*b*. It will be appreciated that the casting surfaces 12*a*, 14*a* contact the freezing molten metal and the cooling surfaces 12*b*, 14*b* are cooled by coolant from the cooling bar means as will be explained below in further detail.

Also provided are a pair of movable opposed dam block means 30, 32, each including a plurality of dam blocks, such as dam block 34 on dam block means 30 and dam block 36 on dam block means 32. Each of the dam blocks are mounted on respective orbiting means which consists of chains 43, 44 to which the dam blocks are mounted and frame members 45, 46 respectively relative to which the chains 43, 44 move. The chains 43, 44 are orbited by a motor (not shown) so that the dam block means 30 and 32 are self powered. The dam block means 30, 32 are supported by support members (not shown) which extend from frame members 45, 46 the support members being in contact with the floor of the building containing the caster 10. The dam blocks are preferably made of copper and each have a casting surface, such as casting surface 34*a* on dam block 34 and casting surface 36*a* on dam block 36. It will be appreciated that the casting surfaces 34*a* and 36*a* of the dam blocks will contact the freezing molten metal in the caster 10 as will be explained in detail hereinbelow.

Although self powered movable dam block means 30, 32 are shown, it will be appreciated that other arrangements for the side dams can be used. For example, stationary side dams can be used which are supported by the caster frame and positioned to form the bar casting zone. Another embodiment involves mounting a plurality of side dams on both edges of one of the orbiting belts. The side dams are constructed and arranged such that when they are in the casting zone, they are linked together to form a continuous sidewall to confine the molten metal in the bar casting zone and when the side dams exit the bar casting zone, the side dams, similar to a bicycle chain, become separated so that they may go around the drive pulley.

Figure 4:
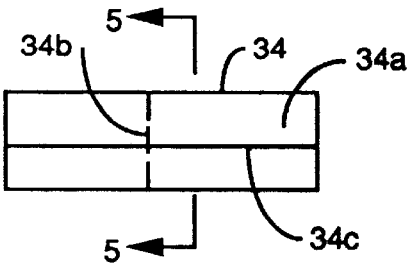
FIG. 4 is a view taken along line 4—4 of FIG. 3.
Figure 5:
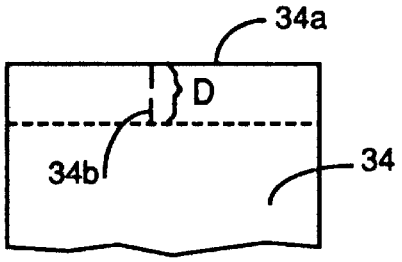
FIG. 5 is a cross-sectional view taken along line 5—5 of FIG. 4.

Referring now to FIGS. 4 and 5, it will be seen that the casting surface 34*a* of dam block 34 includes a pair of slits 34*b*, 34*c* which are oriented generally perpendicularly to each other. The slits 34*b*, 34*c* have a depth, D, shown in FIG. 5. The objective of this arrangement is to maintain a flat block surface while at the same time facilitating thermal expansion and contraction of the dam block 34 when it is used in the casting operation. Care must be taken in the configuration of the slits 34*b*, 34*c*, however, in order to resist molten metal from entering the slits 34*b*, 34*c*. This is done by limiting the thickness of the slits to avoid metal penetration.

The bar caster 10 further includes a tundish 60 for introducing molten metal 64, such as molten aluminum, into the caster 10. The molten metal 64 is supplied from a trough (not shown) leading from a holding furnace (also not shown) and can be treated or fluxed before reaching the tundish 60. The molten metal 64 then passes through the tundish and into the nozzle 66 for delivery into the bar casting zone (described in detail below).

A pair of cooling plate or bar means 70 and 72 (cooling bar means 70 only is shown in FIG. 1), are disposed behind belts 12 and 14 respectively. The cooling wall means 70 and 72 are mounted in the frames (not shown) which support the rolls and belts. The cooling wall means supply coolant, such as water, from a coolant source through a manifold, such as manifold 74 for cooling plate means 70 (FIG. 1), which is directed at the cooling surface 12*b* of the belt 12 as will be explained in detail in FIGS. 7–10 below. Multiple manifolds, such as manifolds 74*a* and 74*b* can be provided in the cooling wall means 70. The cooling plate or bar means 70 and 72 are relatively narrow in a bar caster to correspond generally to the width of the bar being cast and are wider in a strip caster to generally correspond with the width of the strip being cast.

As can best be seen in FIG. 2, spring loaded belt seal 80 for belt 12 and spring loaded belt seal 82 for belt 14 are provided. These belts seals 80 and 82 help to resist the escape of molten metal from the bar casting zone and also maintain intimate belt/mold contact. The belt seals can be similar in design and operation as those shown in U.S. Pat. No. 4,785,873, which is expressly incorporated by reference herein.

As also can best be seen in FIG. 2, belt support shoes 90, 91 for belt 12 and 92, 93 for belt 14 are also provided. The belt support shoes increase the spacing of the rolls from each other and thus in turn create a larger space between the belts. This allows for adjustment of the head pressure from the tundish 60 because a larger range of vertical positions for the tundish 60 is possible. Furthermore, this allows the cooling bar means 70 and 72 to be placed closer to the nozzle 66 so that cooling of the belts 12 and 14 can begin as soon as molten metal is in contact with the belts 12 and 14. Finally, the extra space can be used to fit induction heaters 94 and 95 close to the point where the molten metal contacts the belts 12 and 14. It will be appreciated that belt shoes 91 and 93 can be eliminated and the diameter of rolls 22 and 26 can be increased to accommodate the use of belt shoes 90 and 92.

Figure 6:
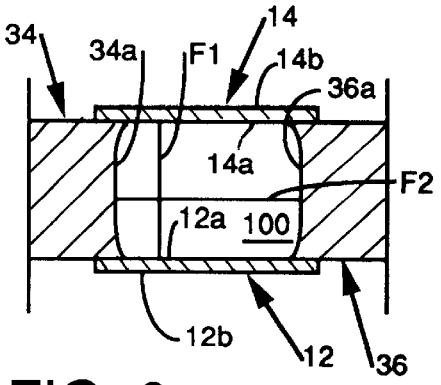
FIG. 6 is a horizontal section through the bar casting zone.

Referring now to FIG. 6, a horizontal section of the bar caster 10 showing a cross-section of the bar casting zone 100 is shown. The bar casting zone 100 is defined by the casting surfaces 34*a*, 36*a* of the dam blocks 34, 36 and the casting surfaces 12*a*, 14*a* of belts 12 and 14. The belts 12 and 14 have a width that is greater than the width of the casting zone 100, as can be seen in FIG. 6 in order for the dam block means 30 and 32 to form a mold for the casting of the metallic bar.

The casting zone is generally in the form of a rectangle and the typical dimensions of the cross-sectional area of the product being cast. In the bar caster shown in FIG. 6, the casting zone 100 can be two inches by three inches (2"×3"); two inches by four inches (2"×4"); three inches by four inches (3"×4"); or three inches by three inches (3"×3"). The bar casting zone preferably has contoured corners as is shown in FIG. 6 which are formed by the complementary shaped dam blocks 34 and 36. Contoured corners for the as-cast bar facilitate lower stress during rolling and avoid slivers and cracking of the bar. More generally, and as used herein, the casting zone 100 in the bar caster is defined as having a cross-sectional shape generally in the form of a rectangle comprising a first dimension F1 and a second dimension F2 that is about 50% to 400% of the first dimension. In a strip caster, the casting zone may be in the form of a rectangle having a first dimension of 1 to 2 inches or less and a second dimension of 10 to 80 inches or more.

FIG. 7 and FIGS. 7A, 7B, 7C and 7D show the solidification of the molten metal 64 into a cast bar. The molten metal 64 is introduced into the bar casting zone 100 through tundish 60 and nozzle 66. Upon entering the bar casting zone 100, the molten metal 64 is completely molten but quickly a shell 102 solidifies on the outside edges of the molten metal to start to form the metallic bar. Heat is transferred from the solidifying molten metal through the belts 12 and 14, which are cooled by cooling bars 70 and 72. As that occurs, the molten metal solidifies from the outside in to form a solid shell portion 102, a mushy zone 104 and a molten center zone 106. As the bar moves through the bar casting zone 100, heat is continued to be removed from the molten metal, and the bar continues to solidify. The characteristic V-shape (or sump) is formed in the bar casting zone by the boundaries between the solid shell portion 102, the mushy zone 104 and the liquid center zone 106. The bar 110 becomes completely solid and then exits the bar caster 10 for further processing, such as shape rolling or cutting into straight pieces. The exit temperature is preferably in the range of 800° to 1000° F.

Molten aluminum can be cast into aluminum bar by using the caster of the invention. Although any aluminum alloy can be cast, the most likely alloys for bar casters come from the following Aluminum Association designations: 2XXX, 3XXX, 4XXX, 5XXX, 6XXX and 7XXX. The bar caster 10 is especially effective for the so-called "hard alloys" (2XXX, 4XXX, 6XXX and 7XXX alloys) which simply could not be cast using prior art continuous bar casting apparatus and methods because of their long freezing range. The generally vertical bar caster provides a metal head that facilitates excellent molten metal to belt contact and excellent molten metal feed over the entire cross-section during initial solidification. This facilitates a short mushy zone. The generally vertical bar caster inherently has equal solidification of all sides. Furthermore, due to the design of the cooling nozzles, excellent belt to bar contact is maintained. These all lead to an excellent cast bar product which minimizes the problems associated with other cast bar products, such as surface liquations and centerline segregation.

In proper forming of the cast products such as bar and strip, there are several critical elements which must be controlled. First, the belts must be resisted from distorting upon first coming into contact with the molten metal from the nozzle 66. If waves or other distortions (known in the art as "buckling") of the belts occur, this can adversely affect surface quality. Secondly, as the product solidifies, the belt must maintain intimate contact therewith in order to resist air gaps from being created between the belt and the bar. This will prevent remelting of the partially solidified shell. This remelting causes a defect called surface liquations. Also, there must be efficient heat transfer from the solidifying product through the belt. This will enhance the metallurgical qualities of the cast product and minimize such things such as centerline segregation.

Figure 8:
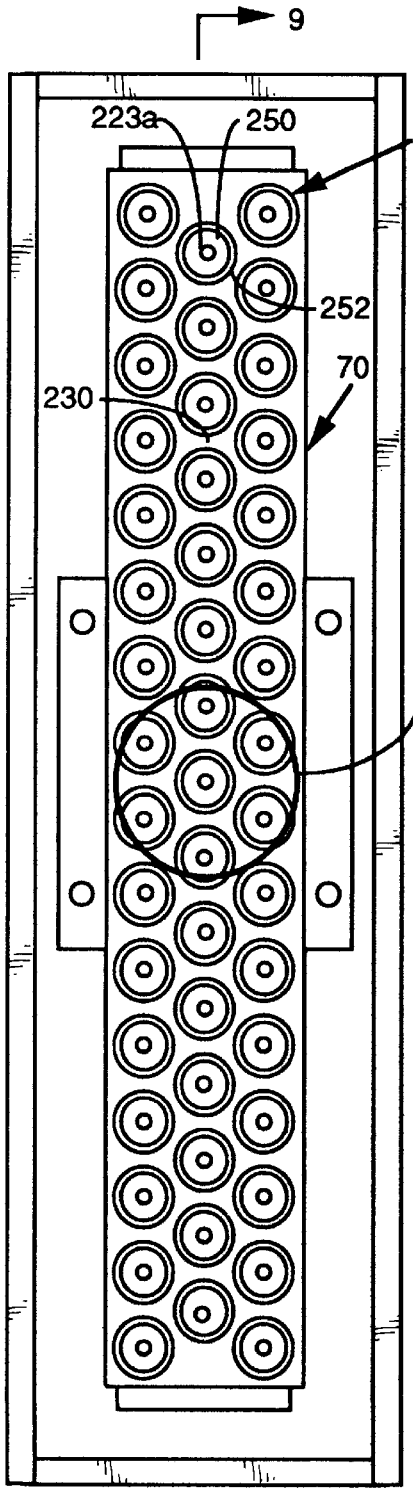
FIG. 8 is a front elevational view of one of the bar cooling means.
Figure 9:
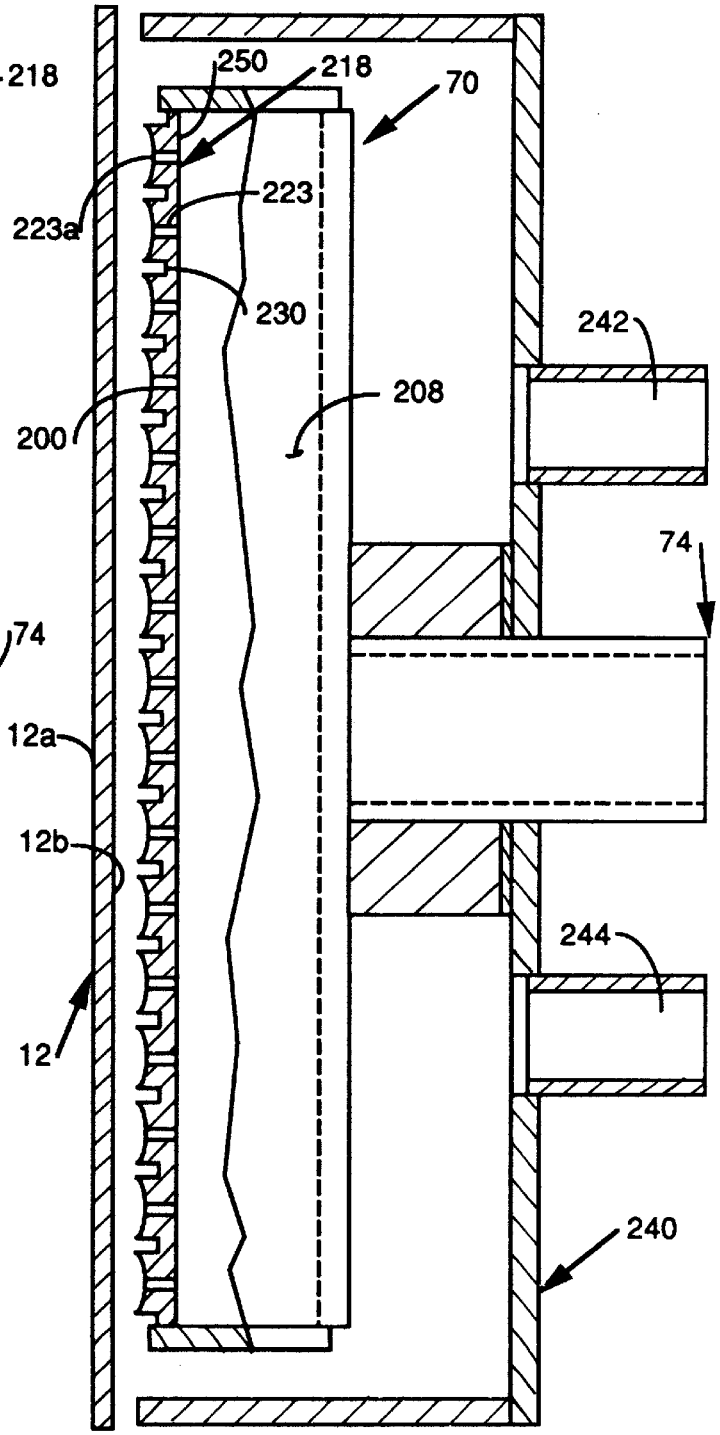
FIG. 9 is a cross-sectional view taken along line 9—9 of FIG. 8 and also showing the belt as it is positioned relative to the cooling bar means.

The design of the cooling plate/bar 70, 72 resists distortion of the belts 12, 14 when the molten metal enters the casting zone 100 and also maintains intimate contact on the solidifying cast product. Referring to FIGS. 8 and 9, cooling plate means 70 (which is similar to cooling plate means 72 so only one will be explained in detail) is a hollow structure having a cooling wall 200 which faces the cooling surface 12*b* of belt 12. Coolant (such as water) is introduced from a coolant source (not shown) into manifold 74. The manifold 74 is shown positioned centrally in the cooling plate/bar means 70 although it will be appreciated that it can be placed in different positions. Coolant is supplied at about 40–60 psi and fills the hollow cavity 208 formed by the walls of the cooling plate/bar means 70.

The cooling wall 200 has a plurality of generally circular nozzles such as nozzle 218, as can best be seen in FIG. 8. As can be seen in FIG. 9, the nozzles each define a passageway 223 located centrally therein and terminating at an orifice 223*a* which produces a jet of water directed at the cooling surface 12*b* of the belt 12.

The coolant exits the cooling plate/bar means by going into channels 230 (FIGS. 8 and 9) defined by the nozzles and then being drawn off by gravity and also by the aid of the vacuum means 240 shown in FIG. 9. The vacuum means 240 consists of a housing mounted to the back side of the cooling plate/bar means 70. A vacuum from a vacuum supply source (not shown) draws the coolant away from the cooling plate/bar means 70 through outlet pipes 242, 244 by creating a vacuum inside the vacuum means 240 through outlet pipes 242 and 244.

Figure 7A:
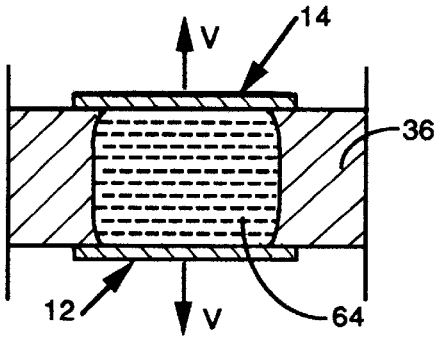
FIG. 7A is a cross-sectional view taken along line 7A—7A of FIG. 7.
Figure 7B:
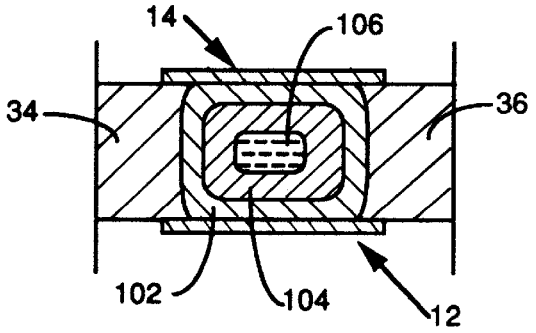
FIG. 7B is a cross-sectional view taken along line 7B—7B of FIG. 7.
Figure 7:
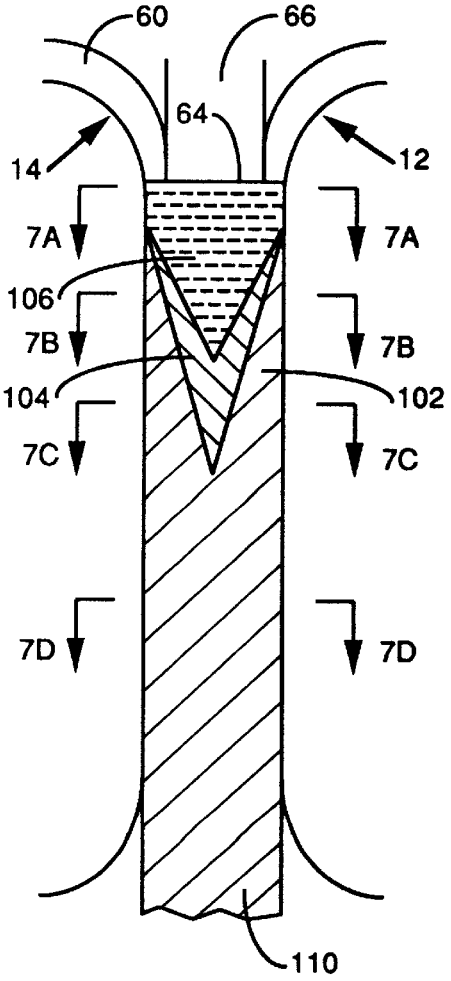
FIG. 7 is a partially schematic vertical section of the bar casting zone showing the belts and a solidifying bar.
Figure 7C:
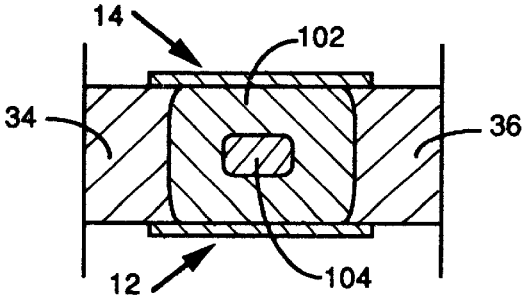
FIG. 7C is a cross-sectional view taken along line 7C—7C of FIG. 7.
Figure 10:
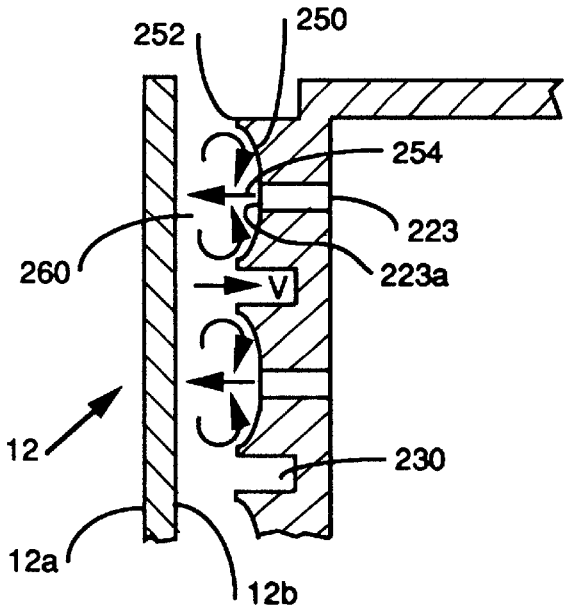
FIG. 10 is detailed elevated-cross-sectional view of the nozzles at the upper portion of the cooling bar means.

In order to resist belt distortion near the upper portion of the casting zone 100, the nozzles in the upper portion are configured as shown in FIG. 10. The nozzles have a concave guiding surface 250 and a flat rim 252. The distance between the flat rim 252 and the cooling surface of the belt 12*b* must be less than the distance between the orifice 223*a* and the cooling surface of the belt 12*b*. The preferred distance between the rim 252 and the cooling side of the belt 12*b* is one sixteenth of an inch (1/16") or less. A jet of water 254 travels through the passageway 223 and exits the orifice 223*a* and swirls as shown in FIG. 10 to create a liquid film 260 upon which the belt 12 moves. It will be appreciated that coolant must also be maintained in area above the nozzle 250 shown in FIG. 10 in order to have the vacuum V created by nozzle 250. Because of the depth of the concave guiding surface, the diameter of the orifice 250, the distance between the rim of the rim 252 and the cooling surface 12*b* of the belt and the water level maintained around the nozzles, a vacuum is created between the belt and the nozzle 250 so as to draw the belt towards the nozzle as shown by arrow V. The vacuum pressure holds the belt in a planar position, so that belt distortion is minimized. The vacuum arrow V is also shown in FIG. 7A.

Figure 7D:
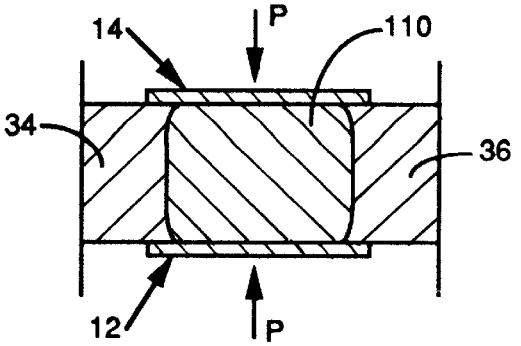
FIG. 7D is a cross-sectional view taken along line 7D—7D of FIG. 7.
Figure 11:
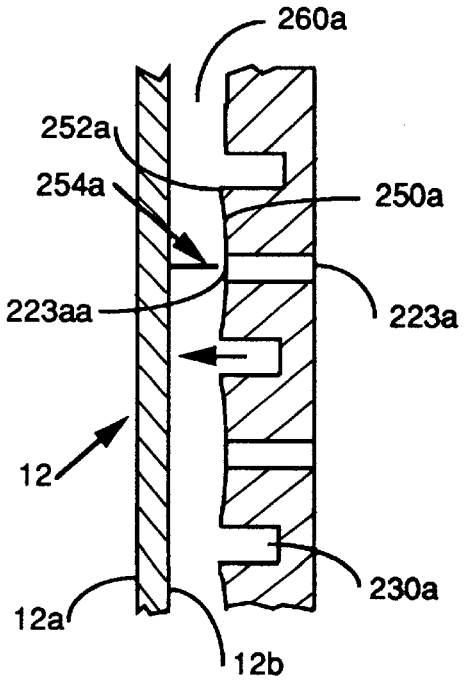
FIG. 11 is a detailed enlarged cross-sectional view of the nozzles at the mid portion of the cooling bar means.
Figure 12:
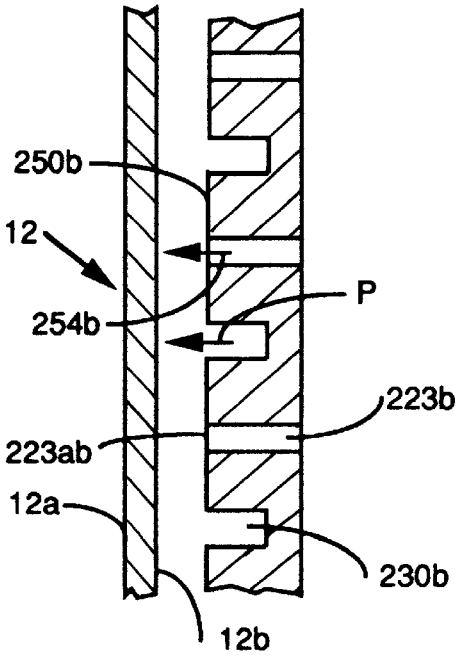
FIG. 12 is a detailed enlarged cross-sectional view of the nozzles at the lower portion of the cooling bar means.

As the bar moves through the casting zone, less vacuum pressure is needed, thus the concave guiding surfaces are not as deep. This can be shown in FIG. 11 which shows the nozzles at a mid-portion of the cooling bar means. The reference numbers in FIG. 11 point to similar features as are shown in FIG. 10 only with an "a" subscript. Just before the metal totally solidifies in the bar casting zone, the vacuum is not needed at all, and in fact, a positive pressure is needed to maintain belt contact on the solidifying bar in order to maintain contact with the bar because it is contracting in size as it solidifies. Thus, as shown in FIG. 12, (in which similar features as are shown in FIG. 10 are indicated by a "b" subscript) which shows the nozzles at a lower portion of the cooling bar means, the guiding surfaces are generally flat, and thus a positive pressure P from the jet of water is exerted on the cooling surface of the belt in order to move the belt into contact with solid bar. The diameter of the orifice, although shown unchanged from the orifice diameter in the upper section, can also be decreased to create a greater pressure. The pressure arrow P is also shown in FIG. 7D.

It will be appreciated that by changing the depth of the guiding surfaces and the diameter of the orifices, the vacuum and pressure forces on the belts can be altered. Thus, the vertical bar caster 10 can be used successfully to cast different alloys having different solidification rates. Also, the heat transfer in the caster can be more effectively controlled thus leading to higher quality cast bar.

The method of the invention comprises providing a vertical caster as shown in FIGS. 1–12 and solidifying the molten metal supplied in the caster in a casting zone defined by the casting surfaces of the belts and the side dams.

The generally vertical bar caster provides several benefits over prior art continuous bar casting machines. Because the casting process is vertical, metallostatic head is used. The metal head provides an excellent molten metal to belt contact pressure and excellent molten metal feed during initial solidification. This aids in making the mushy zone length as short as possible (see FIG. 7). The bar solidifies equally on both sides and due to the cooling bar design, excellent metal to belt contact is maintained throughout the bar casting zone. This makes for an excellent cast product in which surface liquations and centerline segregation are minimized. The belts provide an excellent heat transfer mechanism and do not need to be coated, preheated or lubricated.

It will be appreciated that although emphasis throughout the specification has focussed on casting molten aluminum, other molten metals such as, for example, copper, zinc, steel and lead, could be cast using the bar caster of the invention and the method of the invention. The invention also contemplates a cast metal bar made by the method of the invention and a cast aluminum bar made by the method of the invention.

It will also be appreciated that although the figures and above description thereof has focused primarily on a bar caster, the invention also applies to strip and slab casters, the main difference being in the dimensions and not structure. In fact, the need for maintaining contact of the belt to the cast product that is satisfied by this invention may be greater for strip and slab casters than it is for bar casters.

It will be appreciated that a vertical caster and an associated method have been provided wherein the vertical caster produces cast metallic product from molten metal and an associated cast metallic product.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A vertical caster for casting molten metal into cast metal product in a casting zone, said vertical caster having an upper portion and a lower portion with said molten metal being introduced into said upper portion and said metal product exiting said lower portion, said vertical caster further including (i) a pair of movable opposed belts each having a casting surface and a cooling surface; (ii) a pair of opposed side dams having casting surfaces that cooperate with said casting surface of said belts to define a casting zone for solidifying said molten metal into said cast metal product; and (iii) a cooling wall having a plurality of nozzles in it for directing a jet of coolant at said cooling surface of said belt, said nozzles in said upper portion each including a concave guiding surface having a first depth such that said jet of coolant creates a vacuum to pull said belts toward said nozzles such that belt distortion is resisted and said nozzles in said lower portion each including a guiding surface that is either (x) concave having a second depth, said second depth being less than said first depth of said concave guiding surfaces of said nozzles in said upper portion, or (y) substantially flat such that said jet of coolant creates a pressure to push said belt away from said nozzles such that intimate surface-to-surface contact between said casting surfaces of said belt and the solidifying molten metal is maintained.

2. The caster of claim 1, wherein said nozzles are spaced apart from each other so as to define channels for said coolant to be drained from said cooling wall; and said drained coolant is removed from said caster by vacuum means.

3. The caster of claim 1, wherein at least some of said nozzles have a concave guiding surface which face said cooling surface of said belt and a coolant passageway disposed generally centrally in said guiding surface, whereby said coolant forms a liquid film on which said belt travels while said belt moves through said casting zone.

4. The caster of claim 3, wherein said guiding surface includes a rim having a generally planar surface, said planar surface being generally parallel to said cooling surface of said belt.

5. The caster of claim 1 which is a bar caster, wherein said bar casting zone is generally rectangular in cross-section having a first dimension and a second dimension, said second dimension being between about 50% to 400% of said first dimension.

6. The caster of claim 1, wherein said casting zone is formed by a portion of said casting surface of said belt and said side dams; and the dimension of said casting zone formed by said portion of said casting surface of said belt is greater than the dimension of said casting zone formed by said side dams.

7. The caster of claim 1 which is a strip or slab caster.

8. The caster of claim 1, wherein said casting surface of said side dams has at least one slit for accommodating thermal expansion of said dams.

9. The caster of claim 1, including separate means for moving each of said belts into said casting zone, each of said moving means comprising:

a first roll disposed above said casting zone;

a second roll disposed below said casting zone;

a belt support shoe for guiding and supporting said belt after said belt travels over said first roll but before said belt reaches said upper portion of said casting zone, said belt support shoe defining a space created above said casting zone which is greater than the distance between said belts so that (i) molten metal head pressure for said molten metal which is delivered into said casting zone can be adjusted; (ii) ancillary apparatus can fit in said space; and (iii) said cooling wall means can be positioned more nearly adjacent the point where said molten metal first enters said casting zone.

10. The caster of claim 1, wherein said belts are endless belts.

11. The caster of claim 9, wherein said ancillary apparatus includes induction heating means disposed in said space for heating said belts before said belts enter said casting zone.

12. The caster of claim 1, including a tundish having a feeding tip for feeding molten metal into said casting zone, said feeding tip having a portion disposed in said casting zone; and spring biased sealing means for biasing said belt into intimate surface-to-surface contact with said feeding tip so that said molten metal is resisted from leaking from said casting zone.

13. The caster of claim 1, wherein said nozzles have a circular cross-sectional shape.

14. The caster of claim 1, wherein each of said opposed side dams comprise a plurality of dam blocks having one end mounted to an orbiting support, and said casting surface is opposite to said one end.

15. A vertical strip caster for casting molten metal into cast metal strip in a casting zone, said vertical strip caster having an upper portion and a lower portion with said molten metal being introduced into said upper portion and said cast metal strip exiting said lower portion, said vertical strip caster further including (i) a pair of movable opposed belts each having a casting surface and a cooling surface; (ii) a pair of opposed side dams having casting surfaces that cooperate with said casting surface of said belts to define a casting zone for solidifying said molten metal into said cast cast metal strip; and (iii) a cooling wall having a plurality of nozzles disposed in it for directing a jet of coolant at said cooling surface of said belt, said nozzles being spaced apart so as to define channels therebetween for said coolant to be drained from said cooling wall and be removed from said caster by vacuum means, said nozzles in said upper portion each including a concave guiding surface having a first depth such that said jet of coolant creates a vacuum to pull said belts toward said nozzles such that belt distortion is resisted and said nozzles in said lower portion each including a guiding surface that is either (x) concave having a second depth, said second depth being less than said first depth of said concave guiding surfaces of said nozzles in said upper portion, or (y) substantially flat such that said jet of coolant creates a pressure to push said belt away from said nozzles such that intimate surface-to-surface contact between said casting surfaces of said belt and the solidifying molten metal is maintained.

16. The caster of claim 15, wherein at least some of said nozzles have a concave guiding surface which face said cooling surface of said belt and a coolant passageway disposed generally centrally in said guiding surface, whereby said coolant forms a liquid film on which said belt travels while said belt moves through said casting zone.

17. The caster of claim 16, wherein said guiding surface includes a rim having a generally planar surface, said planar surface being generally parallel to said cooling surface of said belt.

18. A method of casting molten metal into a cast metal product, said method comprising:

providing a vertical caster having an upper portion and a lower portion, (i) a pair of movable opposed belts each having a casting surface and a cooling surface; (ii) a pair of opposed side dams having casting surfaces that cooperate with said casting surface of said belts to define a casting zone for solidifying said molten metal into said cast metal product; and (iii) a cooling wall having a plurality of nozzles in it for directing a jet of coolant at said cooling surface of said belt, said nozzles in said upper portion each including a concave guiding surface having a first depth such that said jet of coolant creates a vacuum to pull said belts toward said nozzles such that belt distortion is resisted and said nozzles in said lower portion each including a guiding surface that is either (x) concave having a second depth, said second depth being less than said first depth of said concave guiding surfaces of said nozzles in said upper portion, or (y) substantially flat such that said jet of coolant creates a pressure to push said belt away from said nozzles such that intimate surface-to-surface contact between said casting surfaces of said belt and the solidifying molten metal is maintained;

introducing molten metal into said upper portion;

solidifying said molten metal in said casting zone; and removing said cast product from said lower portion.

19. The method of claim 18, wherein said nozzles are spaced apart from each other so as to define channels for said coolant to be drained from said cooling wall; and said drained coolant is removed from said caster by vacuum means.

20. The method of claim 18, wherein at least some of said nozzles have a concave guiding surface which face said cooling surface of said belt and a coolant passageway disposed generally centrally in said guiding surface, whereby said coolant forms a liquid film on which said belt travels while said belt moves through said casting zone.

* * * * *